United States Patent [19]

Delaplace et al.

[11] 4,201,248

[45] May 6, 1980

[54] PROCESS AND APPARATUS FOR SINGLE-FILLING MANUFACTURE OF DOUBLE-NAP FABRICS

[75] Inventors: Philippe Delaplace; Pierre Bernard, both of Amiens, France

[73] Assignee: Lindauer Dornier Gesellschaft mbH, Fed. Rep. of Germany

[21] Appl. No.: 948,579

[22] Filed: Oct. 4, 1978

[30] Foreign Application Priority Data

Oct. 5, 1977 [DE] Fed. Rep. of Germany ..... 2744795

[51] Int. Cl.[2] ..... D03D 39/16

[52] U.S. Cl. ..... 139/21; 139/55.1; 139/82

[58] Field of Search ..... 139/55.1, 20, 21, 22, 139/23, 26, 79, 80, 82

[56] References Cited

U.S. PATENT DOCUMENTS

| | | | |
|---|---|---|---|
| 257,517 | 5/1882 | Rothwell et al. | 139/26 |
| 1,265,616 | 5/1918 | Cooper et al. | 139/20 |
| 3,232,319 | 2/1966 | Marco | 139/20 |

*Primary Examiner*—Henry Jaudon

*Attorney, Agent, or Firm*—James E. Bryan

[57] ABSTRACT

This invention relates to an improvement in the method for the single-filling manufacture of double nap fabrics, wherein the filing yarn for face and back fabrics is inserted at the same place into the shed, the improvement comprising superposing an additional lifting motion to the normal motion emanating from a dobby at least for shafts forming the shed of the warp for one of the two fabrics. The invention also relates to a weaving machine for the manufacture of double nap fabrics.

11 Claims, 12 Drawing Figures

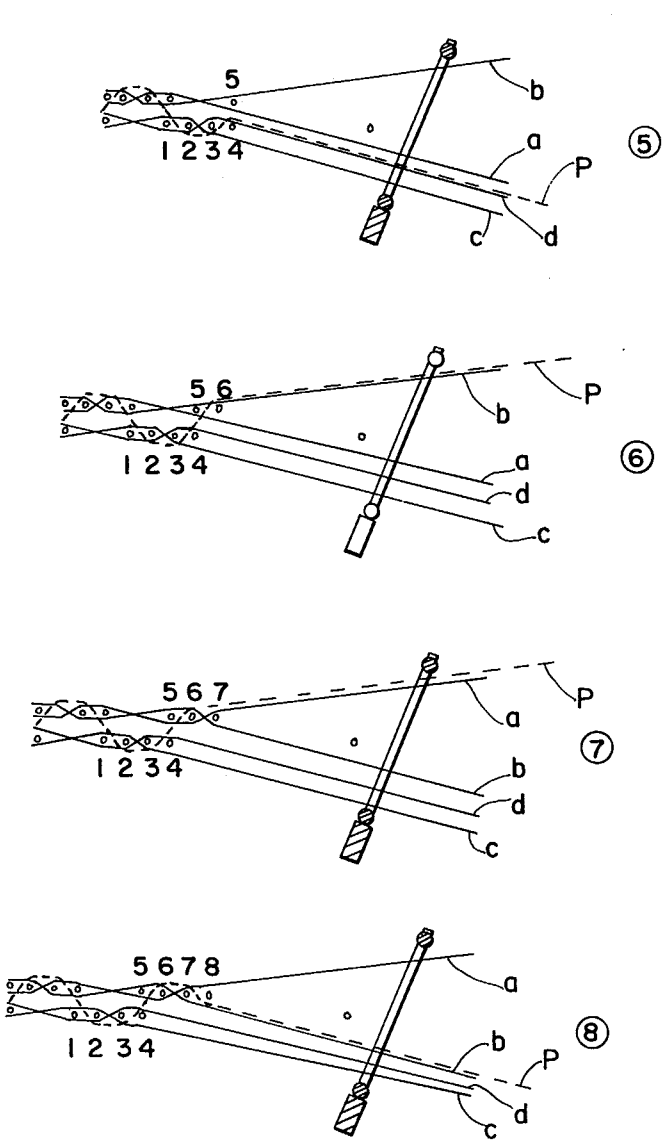
FIG. 5
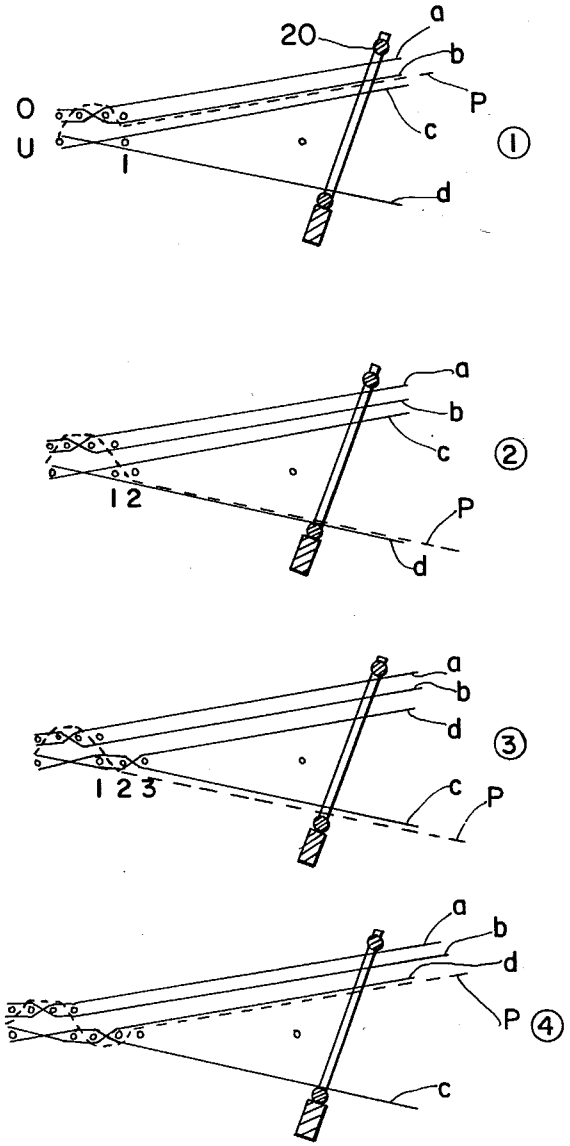

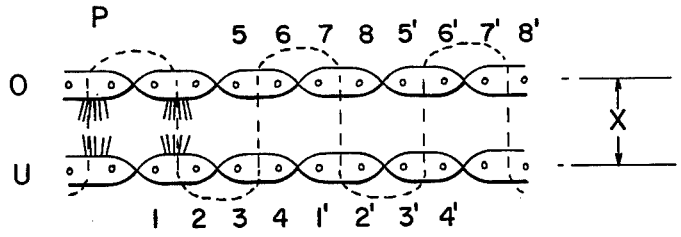
FIG. 7
FIG. 8a
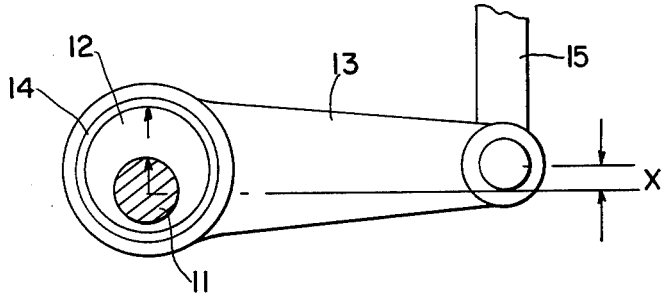
FIG. 8b
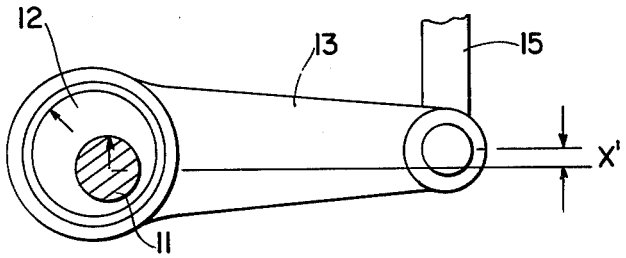
FIG. 8c
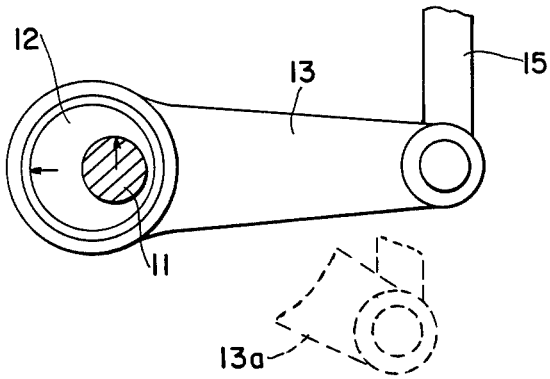

PROCESS AND APPARATUS FOR SINGLE-FILLING MANUFACTURE OF DOUBLE-NAP FABRICS

This invention relates to a method and apparatus for manufacturing single-filling double nap fabrics. In such single-filling procedures, the filling for the face and back cloths is inserted at the same place into the shed.

In practice, a weaving machine with simultaneous filling insertion in two sheds one above the other has been found appropriate for double nap fabrics. A special filling inserting component, for instance a shuttle or gripper, is provided for each shed. Because of their technical characteristics, these machines offer advantages regarding wholly efficient filling insertion for the two fabrics and the precise adjustability of the height of the nap in these fabrics. However, the weaving machines with double filling insertion are less advantageous as regards economy. It is known from experience that the market for flat woven fabrics or double nap fabrics fluctuates according to fashion. As a result, if there is strong demand but insufficient machinery, not enough can be produced, or if there is sufficient machinery the demand can be met, though then the capacity to produce will not be utilized when demand is slack and hence financial losses are incurred.

It is advantageous therefore for the relevant industry, namely for upholstering materials, outerwear etc., to be able to put machinery into operation which selectively allows the manufacture of flat fabrics or of double nap fabrics (for instance velvet, plush etc.).

It is known in principle to manufacture double nap fabrics by the single filling method, that is, by inserting the filling into each shed always at the same place but sequentially. For a variety of reasons this known process was found unsuitable in practice. One reason is that the efficiency of filling insertion is considerably less than for the above cited machine with simultaneous insertion of the filling into two sheds, and another is that when weaving nap or velvet fabrics on single-filling double nap weaving machines, the reed beat-up position for the face cloth and hence the precise nap height could not so far be exactly set. The height of the nap is determined by the distance between the face and back cloths at the time of the reed beat-up. This distance is affected by the pile thread tension, in other words, if this tension is insufficient, the distance between the face and back cloths will fluctuate and hence the height of the nap. This represents a special drawback of the prior single-filling weaving for double-nap fabrics.

The present invention therefore addresses the task of preventing the cited drawbacks of the single-filling manufacture of double nap fabrics and to provide a method achieving a constant distance between the face and back cloths at the time of reed beat-up and accordingly a constant nap height. Furthermore, the nap height also should be easily adjustable according to requirements.

This problem is solved by the invention by using a method in which an additional stroke motion is superposed to the conventional motion taking place in a dobby for the shafts forming the shed, at least as regards the shafts of the ground warp for one of the two fabrics. This additional, superposed lift unambiguously determines the nap height at the time of the reed beat-up. This method is universally applicable and independent of the manner of filling insertion, for instance whether by advanced or retracted gripper rods, gripper shuttles, pneumatic filling insertion, etc. The method now may be carried out eliminating an expensive multiple-adjustment, shed-forming system as is required for the double-filling nap fabrics, rather a conventional shed-formation system for a conventional weaving machine now suffices. The method therefore also permits adjustment of the nap height by varying the motion of the lift. This variation may be stepwise or continuous. The method furthermore may be so varied that the superposed lift motion can be adjusted between a maximum value and null at the time of reed beat-up. This means that for the null value the mode of operation can be switched from double-nap fabrics to flat fabrics. No special conversion of the machinery is required, nor are any additional parts needed. The weaving machine therefore is of versatile application. Accordingly the requirements of economy initially mentioned regarding the use at full capacity of such machinery is fully met.

The technical implementation of the superposed lift motion may take many forms. A particularly advantageous embodiment is that machinery comprising switching levers for the dobby controlling the motion of the individual shafts and these individual shafts (a) is provided with a rotatably supported shaft performing one revolution per operational cycle and acting as the bearing for the switching levers of the shaft drive, and (b) is provided with circular eccentrics on the shaft acting as bearings for the switching levers of the shafts of the ground warp implementing the superposed motion.

It may be stated with regard to the applicability of the method that the superposed motion must act not only on the shafts of the ground warp of a fabric, but also may act on both fabrics. In such a case the superposed motions advantageously are of opposite directions. This again allows affecting the nap height, i.e., it again can be increased. Obviously it is also possible, where required, to so set the motions for the shafts of the ground warps of the two fabrics that they are mutually independent. One embodiment of the invention is discussed below in relation to the accompanying drawings, in which;

Figure 1:
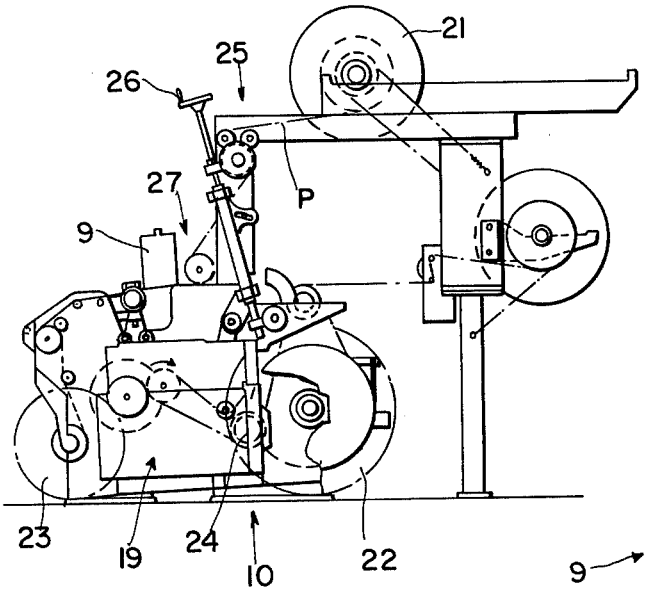
FIG. 1 is a side view of a weaving machine.
Figure 3:
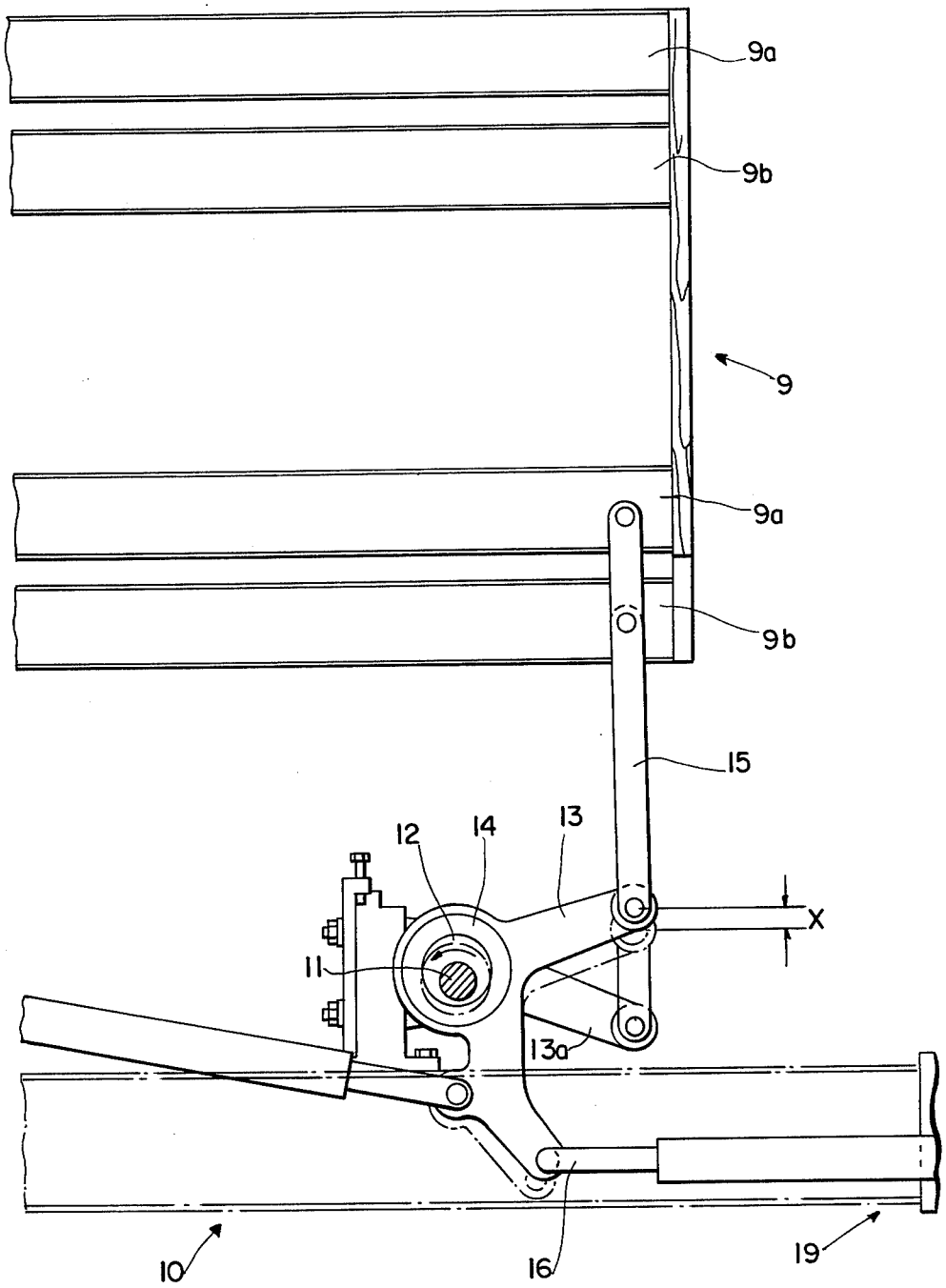
Figure 4:
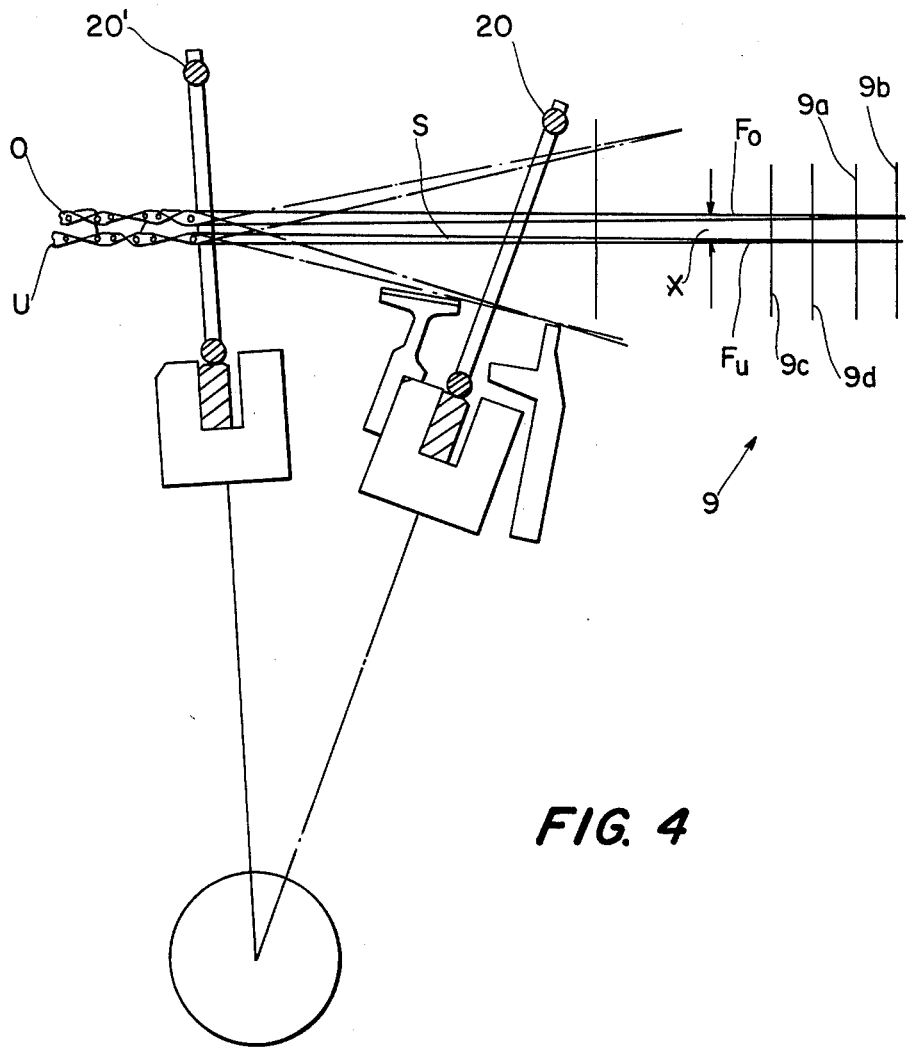
Figure 6:
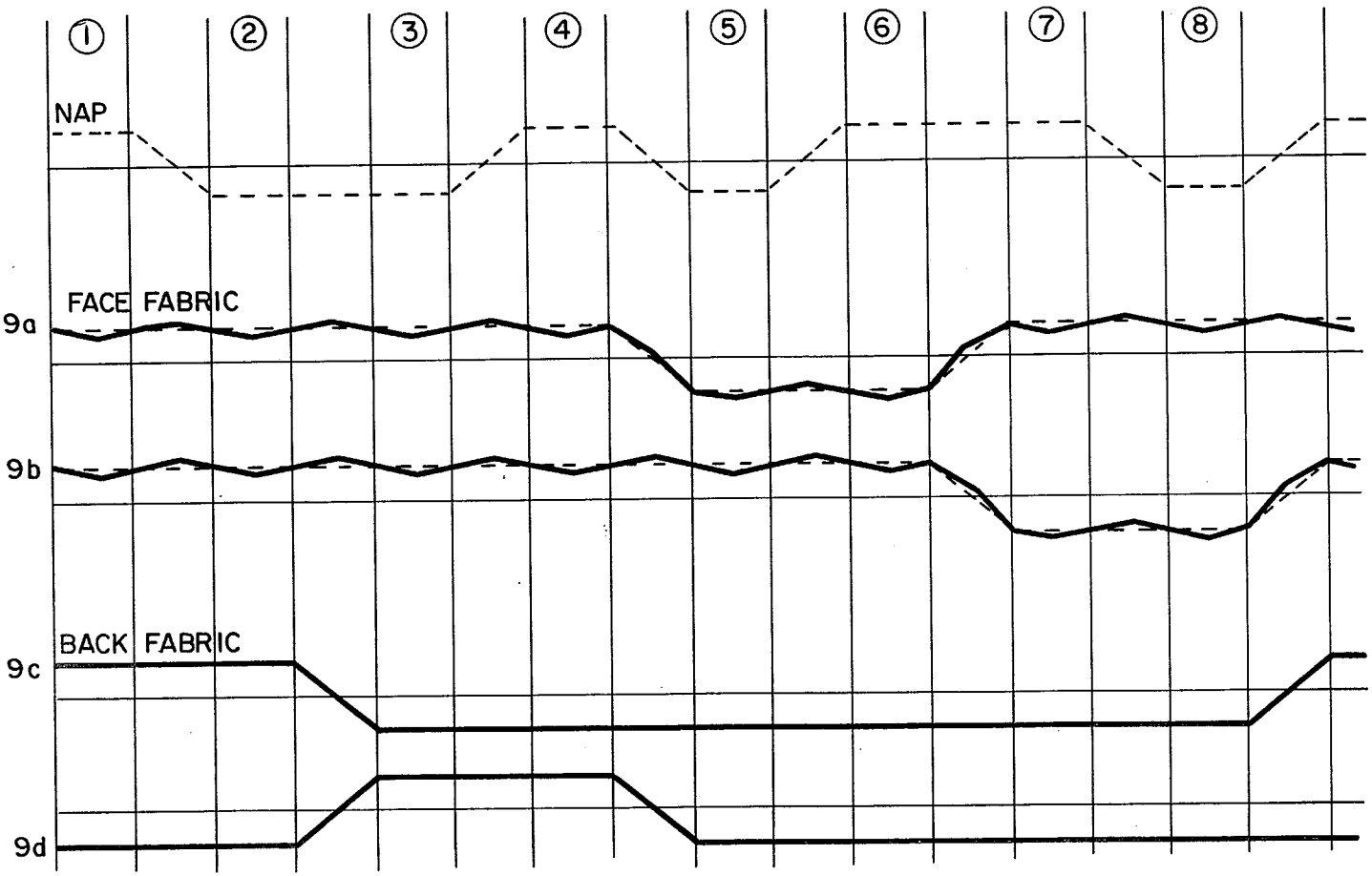
Figure 9:
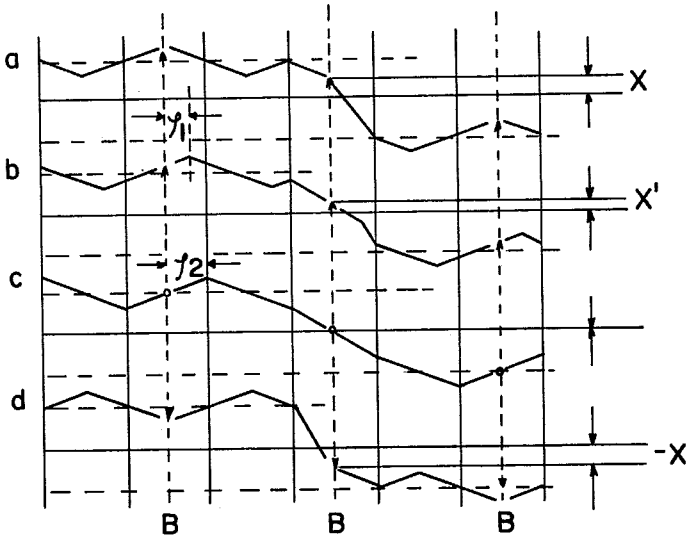
Figure 10:
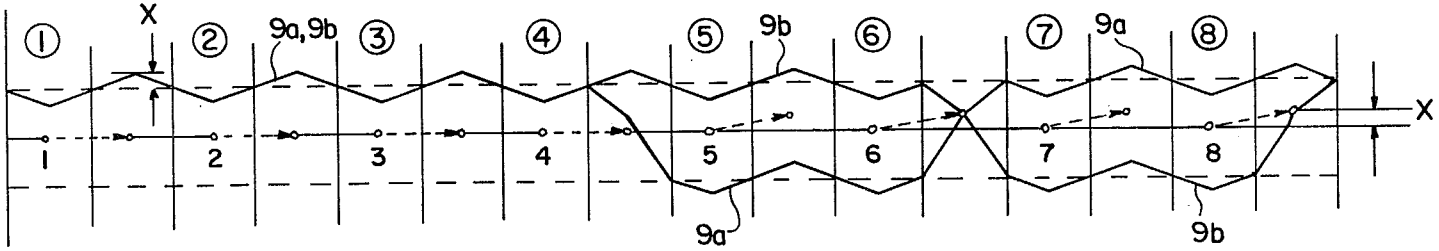

FIG. 3 is an overview of the arrangement of the heddle shafts in a front view, FIG. 4 shows the formation of the shed, FIG. 5 illustrates multi-step cloth-making, FIG. 6 is a diagram of motion of the heddle shafts of the embodiment of FIG. 5, FIG. 7 is a schematic view of a finished piece of fabric, FIG. 8*a* shows the maximum superposed lift amplitude for the switching levers in the heddle drive mode, FIG. 8*b* shows an intermediate value of the superposed lift amplitude, FIG. 8*c* shows the absence of superposed lift amplitude, FIG. 9 is a variation of a diagram of motion of the heddle shafts, and FIG. 10 is a further diagram of motion of the heddle shafts. FIG. 1, which is an overview, shows in a simplified manner the overall assembly of a weaving machine in a side view. Only the major components are shown and referenced. An arrow indicates the structure 10 of the machine. The warp beam for ground warps of both fabrics is denoted by 22, and the cloth beam by 23. The nap warp beam 21 is mounted in the upper part of the machine, delivering the nap yarns P. These nap yarns are taken off in the particular amounts required by means of an adjustable feed system 25; a yarn tensioning system 27, which for instance may be designed as a double rocker, ensures permanent tensioning of the nap warps. The adjustability of the feed system 25 or of the tensioning system 27 is indicated by means of the control 26. The central drive 24 actuates all machine parts. The set of heddle shafts is denoted by 9. These heddle shafts in turn are driven by the dobby 19 indicated by the arrow. The dobby 19 is driven by the central drive 24.

Figure 2:
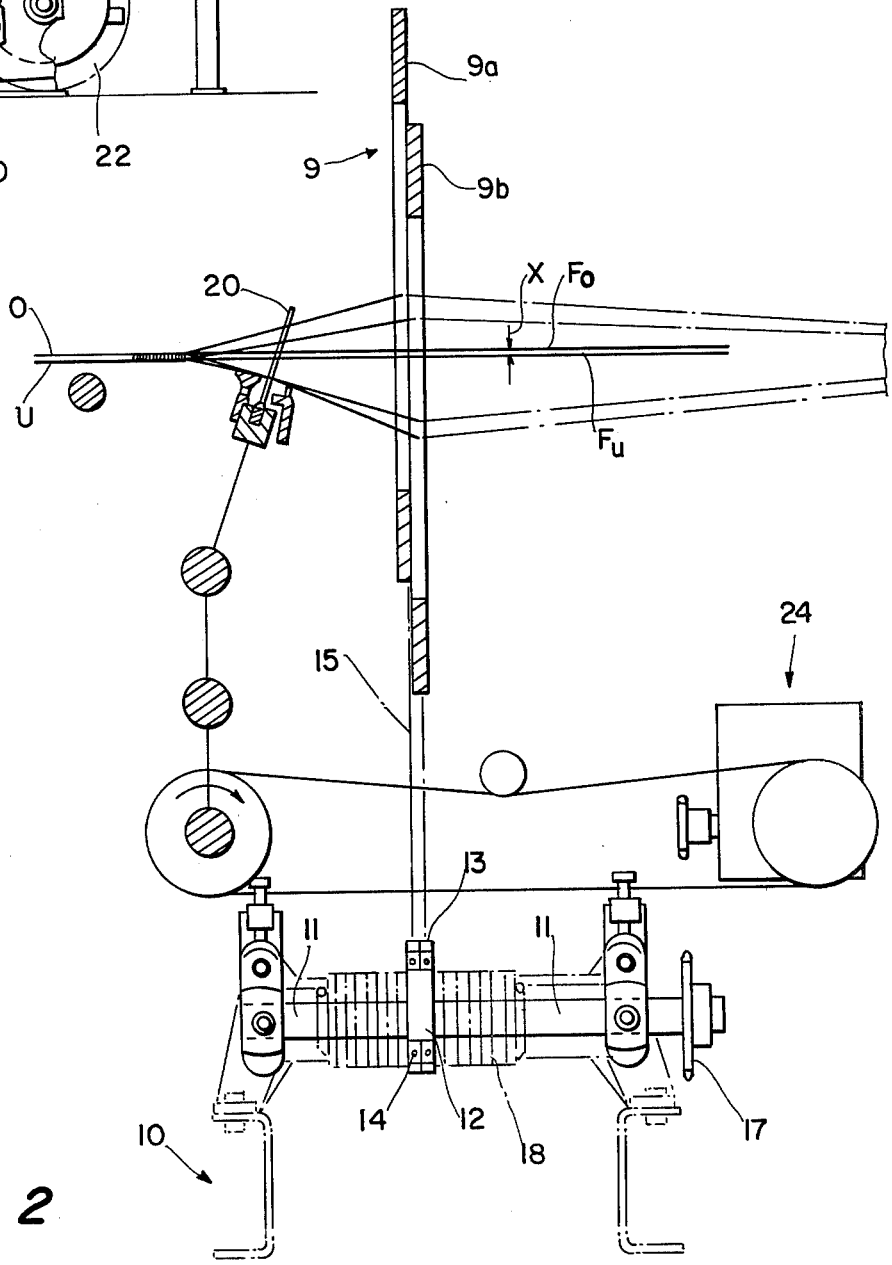
FIG. 2 is an overview of the heddle shafts in a side view.

FIGS. 2 and 3 explain the essence of the invention in detail. Again an arrow 10 denotes the machine structure shown in dash-dot lines. The drive of the heddle shafts will be discussed below. The heddle shafts carry out the conventional basic motion. In the process, the dobby 19 by means of the drive rods 16 actuates the switching levers 13. The frame rods 15 lead from the switching levers 13 to the shafts 9. The shafts **9*a* and 9*b* are selected from the set of shafts to serve as examples. For the illustration selected, the shaft 9*a* is in the high position and shaft 9*b* in the low position for the purpose of forming the shed. The shed formed by the heddle shafts is shown in dash-dot lines in FIG. 2. The reed 20** also is shown. The drive of the reed is conventional and not further illustrated.

The components of the finished double nap fabric are termed O for the face fabric and U for the back fabric. Further, within the shed, the shed closure for the face fabric is denoted by the line $F_o$ and for the back fabric by the line $F_u$. The face and back fabrics O and U respectively or line $F_o$ and $F_u$ respectively are spaced by a distance X. The gap X means the shed offset, and as explained below, determines the nap height of the double fabric.

The previously mentioned switching levers 13 for the shaft drive are rotatably supported on a switching shaft 11. In contrast to the conventional design, the invention does not use a fixed switching shaft 11, but rather it is rotatable. This switching shaft 11 is driven by the central drive 24, i.e., by a chain and sprocket drive 17. The drive is so selected that the switching shaft 11 carries out one revolution per filling, i.e., per reed beat-up.

A large series of shafts is provided in the conventional manner of weaving machinery. At least two shafts are provided for each of the ground warps of the back and face fabrics U and O respectively. Also at least one shaft is required for the nap yarn P. In the illustrative embodiment selected here, the shafts **9*a* and 9*b* are meant to be associated with the ground warp of the face fabric O. Other figures provide the shafts 9*c* and 9*d*** for the ground warp of the back fabric U.

In this embodiment, the shafts are conventionally rotatably supported on the switching shaft 11. The associated switching levers are denoted by 18 and indicated by dashed lines in FIG. 2. Their actuation is independent of the switching shaft 11 rotating or being fixed. The shafts (such as for the nap yarn) connected to the switching levers 18 (but not shown) carry out the conventional up-and-down motion of the shafts. Here the shafts for the ground warp of the face fabric O are singled out from the set of shafts for special consideration. According to the method of the invention, these just cited shafts have an additional and superposed motion. This superposed motion is generated by th circular eccentrics 12. If it is assumed for the time being that the switching shaft 11 is fixed, in that case the switching levers 13 by means of bearings 14 carry out the conventional motions from the dobby 19, that is, the rocking motion from position 13 and toward **13*a* in FIG. 3. If now according to the invention switching shaft 11 is rotated, then the center of the circular eccentric 12, and hence the bearing center of the switching lever 13, carries out an additional motion which is transmitted by the frame rod 15 to the shafts 9*a* and 9*b*. The superposition of rocker and eccentric motions for the switching levers 13 results now in a superposed vertical reciprocating motion for the shafts. This superposed vertical reciprocation is indicated by X in FIG. 3**. As already mentioned, the magnitude of X corresponds to the offset of the shed and hence also to the nap height of both fabrics.

The superposition motions are so mutually adjusted that the shafts **9*a* and 9*b*** are lifted with respect to the other shafts by an amount X at every reed beat-up for the face fabric. Thus a proper nap height is thereby permanently set.

FIG.4 shows the shed for reed beat-up. The reed is in position 20 during filling insertion and in position 20' for reed beat-up. The filling yarn during filling insertion is approximately in the position shown as S. For reed beat-up and shed closure $F_u$ for the back fabric U, the heddle shafts **9*c* and 9*d*** assume the position shown. The filling S is enclosed between the warps of the back fabric and is beaten against the back fabric U. If the filling yarn S on the other hand is enclosed between the warps of the face fabric O during filling insertion and if then the reed beat-up occurs, the warps for the face fabric O on the other hand are lifted for the purpose of beat-up by the shed offset X into the shed closure position $F_o$ and thus bring the filling yarn S in this case into beat-up against the face fabric O.

FIG.5 is an example of the manufacture of fabric in several steps (1) through (8). This involves insertion of 8 fillings, each time four fillings sequentially into the back fabric U and into the face fabric O. The fillings are serially denoted as 1–8. Similarly to the notation of the shafts **9*a* -9*d* in FIG. 4, the warps in FIG. 5** are denoted by a and b for the face fabric O and by c and d for the back fabric U. The nap yarn P is shown in dashed lines.

Based on the example of FIG. 5, in FIG. 6 the simplified motions of the shafts **9*a* -9*d* for the ground warp and for the nap yarn for the eight consecutive fillings are shown in a diagrm with time as the abscissa. There always is one reed beat-up between the individual steps (1) through (8)** of the filling insertion. It is assumed that the reed beat-up takes place at the middle of the space between two consecutive fillings. The times or intervals for the individual steps are selected freely and are no restriction on the concept of the invention.

The motion of the shaft for the nap yarn is shown in dashed lines. It takes place as in the conventional case between a high and a low position. The motion of shafts **9*c* and 9*d* for the back fabric is equally simple. They too alternate between a high and a low position. The warps c and d of frames 9*c* and 9*d* enclose the filling between themselves in the interval between steps 2 and 3. This corresponds approximately to the position $F_u$ in FIGS. 2 and 4**.

Shafts **9*a* and 9*b* for the ground warps of the face fabric O accompany the (high-low) motion of the sahfts. This motion is shown in thinly dashed lines. To this is added however a second, superposed motion. This second motion is assumed for simplicity to be a straight line with respect to time in this case. It is immaterial to the essence of the invention how this superposed motion is generated. As already mentioned, circular eccentrics 12 on a rotating shaft 11 (FIG. 3) have been assumed in the illustration. For every reed beat-up between two consecutive fillings, the shafts 9***a* and 9*b* are lifted. Together this amounts to a superposed motion shown in solid zig-zag lines for the face fabric. Between steps 6 and 7, the warps a and b of the face fabric enclose the filling between them and lift it together so as to beat it against face fabric O. In FIGS. 2 and 4, this corresponds approximately to the position for the shed closure $F_o$.

FIG. 7 shows in simplified manner the sequence of a set of filling yarns 1 through 8 and of the following set 1' through 8'. Their particular positions in the face fabric O or back fabric U is always shown. Again the nap yarn is shown in dashed lines, and X denotes the shed offset, i.e., the distance between the face and back fabrics O and U respectively. This also determines the nap height when the face and back fabrics O and U respectively are separated, as indicated at the left in FIG. 7.

As already mentioned, the shed offset at reed beat-up determines the nap height. It results therefrom that fabrics may be manufactured with different nap heights merely by changing the superposed lifting motion. The manner in which this is done technically depends upon how the lifting motion is generated. Again, the use of circular eccentrics 12 for supporting the switching levers 13 as shown in the embodiment of the invention offers advantages in this respect. It is possible for instance to merely exchange one kind of circular eccentrics 12 against another of different eccentricity. It is even simpler to achieve such ends when using a continuous adjustment of the superposed lifting motion at reed beat-up. This can be implemented because the circular eccentrics 12 may be rotated with respect to their switching shaft 11. It is no part of the invention how to technically implement such rotation and how to set the phase relationship of the circular eccentrics 12 to shaft 11 and how to lock it, and accordingly no further discussion is provided herein. These are steps familiar to one skilled in the art.

FIG. 8 shows three examples when rotating the circular eccentrics. The position of the switching shaft 11 is always the same in FIGS. 8*a*, 8*b*, and 8*c*. The same angular position is always assumed for the switching shaft 11 at reed beat-up. This position is indicated by a short, upward pointing arrow in the shaded shaft 11. Again, the angular position of the circular eccentric 12 is shown by a short arrow terminating at the circumference of this circular eccentric.

As shown by FIG. 8*a*, the full eccentricity of circular eccentric 12 is effective at the time of the reed beat-up. This means that the switching levers 13 and the shaft rod 15 are offset by a space X. Accordingly, the shafts which are connected also are lifted by the amount X when there is reed beat-up.

An angular rotation of the circular eccentric 12 with respect to the switching shaft 11 of about 45° is assumed in FIG. 8*b*. While the eccentricity of the circular eccentric 12 is unchanged, only the vertical component of the full eccentricity is still effective due to the phase shift at reed beat-up, that is, for the position of the switching shaft 11 as indicated by the arrow. The now decreased vertical component is shown as X' in FIG. 8*b*. This decreased lift is also imparted to the shafts at the time of reed beat-up.

A further angular rotation amounting to a total of 90° is assumed in FIG. 8*c*. The vertical component of the eccentricity between the center of the switching shaft 11 and the center of the circular eccentric 12 is this case has decreased to null. Even though the switching lever 13 and the connected shaft rod 15 still perform a superposed motion to the same extent as in FIG. 8*a* when there is rotation of the circular eccentric 12, and even though that motion is transmitted to the connected shafts, there no longer is any additional lift due to phase shift at the time of reed beat-up. Therefore there will be neither any shed offset at reed beat-up, and accordingly a conventional flat fabric may be manufactured for this phase of the circular eccentric. It is possible therefore by merely rotating the eccentric to so convert a weaving machine that it permits making selectively double nap or flat fabrics. For such a case of smooth weaving, that is when no additional superposed lift is required for the shafts, the rotatable switching shaft 11 advantageously may be locked in position in the neutral position of the circular eccentric 12 as shown. The switching levers 13 thereupon will function without superposed lift. Finally, FIG. 8*c* also shows in dashed lines the position 13*a* of a switching lever. This position corresponds to the conventional basic motion of the switching levers and hence to that of the connected heddle shafts, where the motion is controlled by the conventional dobby.

FIG. 9 is a section from the diagram of motion of FIG. 6 for the shaft 9*a*. In all four processes shown one below the other, the basic motion and also the superposed lift of the shafts are always the same; however, between the individual partial curves a through d there is always a phase shift with respect to time B of the reed beat-up as regards the individual curves.

FIG. 9*a* shows the superposed lifting motion without a phase shift. This results in the largest lift X at the time B of reed beat-up. Lift X is indicated by an upwardly pointing arrow with respect to the base setting of the shafts. This lift also determines the greatest possible nap heights.

A phase shift $\alpha_1$ is assumed in FIG. 9*b*. It is easily seen that therefore at time B of the reed beat-up, the spacing between the basic motion and the superposed lift has become much less and that the arrow as shown is only of the small height X'. The fabric so made accordingly is of lesser nap height.

A phase shift $\alpha_2$ is assumed in FIG. 9*c*. It is such that no additional lift at all takes place at time B of the reed beat-up. This setting corresponds to the above cited possibility to make flat fabrics also using this weaving machine.

FIG. 9*d* shows the conditions for a phase shift of 180°. As seen, the superimposed motion in this case is precisely opposite to the conditions of FIG. 9*a*. At time B of the reed beat-up, the arrow points down, thus resulting in a negative lift X. This means that now there is a shed offset downwardly. Therefore when weaving double fabrics, the shafts for the ground warp of the face fabric may carry out an additional motion upwardly and those for the back fabric 's basic warp are additional motion downwardly. It is even possible to simultaneously superpose an opposite lift motion on the shafts for both ground warps, that is, both for the face fabric O and the back fabric U. In this manner the spacing between the face fabric O and back fabric U can be utilized not only as far as the ordinary shed offset between normal condition and lift at the time of reed beat-up, but even to twice this amount.

A further motion diagram is shown in FIG. 10. This graph also is based on FIG. 6. Whereas in FIG. 6 the motions of the shafts are shown individually, the representation selected in this case shows the motions of the shafts 9*a* and 9*b* simultaneously. As indicated by the graph, the motions of the two shafts 9*a* and 9*b*completely overlap between steps (1) and (4). The two shafts simultaneously are in the high position and there carry out the superposed lifting motion together. However the two shafts carry out separate motions during steps (5) through (8). Thereby one shaft is located in the high position and the other in the low position. The superposed lifting motion is shown for both positions. Again steps (1) through (8) denote the positions for eight successive fillings. Between are the positions for the reed beat-up. Each time an additional lift X is created at reed beat-up.

Filling yarns 1 through 4 are not enclosed between the warps of shafts 9*a* and 9*b* during steps (1) through (4). Their particular position is indicated by small rings on the center line of the diagram of motion. Because the filling yarns are not enclosed between the two warps, they remain wholly unaffected by the superposed motion of the shafts and therefore the warps also are entirely unaffected. Therefore the filling yarn 1 remains at its height during beat-up between steps (1) and (2), as indicated in dashed lines by the arrow pointing to the right from step (1). The same conditions apply also to filling yarns 2, 3, and 4.

On the other hand, filling yarns 5 through 8 are always enclosed between the warps of shafts 9*a* and 9*b* in steps (5) through (8). As now the superposed lifting motion of shafts 9*a* and 9*b* at the reed beat-up becomes effective, and as the associated warps are being raised, therefore the particular inserted filling yarn also will be raised. The arrow shown in dashed lines now slightly points upwardly. The filling yarn is lifted by the magnitude of the shed offset X. Therefore the filling yarn is beaten against the face fabric O and at precise nap height.

As already mentioned, the nap height of the finished fabric corresponds to the shed offset at the time of the reed beat-up. Furthermore, the spacing from the face fabric O to the back fabric U, that is the nap height, also depends upon the tension of the nap yarn. It is appropriate in order to achieve the proper nap height to control the nap yarn supply and the nap yarn tension in addition to the shed offset. It was already indicated in relation to FIG. 1 that the tension of the nap yarn can be regulated by a special device 27, for instance a known double rocker. The kind of regulation is a known step and therefore not an object of the present invention. The possibility of such a control is indicated in FIG. 1 by a regulating device 26 with a handwheel. Futhermore this device 26 can be made to affect, in a manner not further described herein, the system generating the superposed motion and thus correspondingly adjust the additional lift.

Where appropriate, an angular rotation of the circular eccentrics 12 with respect to the switching shaft 11 may be implemented in the selected illustrative embodiment. However, the circular eccentrics 12 also may be fixed with respect to the switching shaft 11 and the entire shaft 11 may have a leading or lagging phase shift with respect to the reed drive.

The method of the invention further makes it possible to achieve an ever accurate nap height even when manufacturing double nap fabrics and besides to set in simple manner any desired nap height. As is shown, the range of adjustment is so wide that there can be conversion from the manufacture of double nap fabrics to single flat fabrics without incurring great labor or change in machinery. Further, the complex and costly systems required for shed formation in double filling weaving procedures no longer are needed, rather one simple, ordinary shed forming mechanism suffices. It is true that the filling insertion efficiency is less than in the case of the double filling weaving procedure, but this is no weighty matter because the drawback so incurred may be easily compensated for where desired by weaving at double width. What is essential is that the economy of present machinery is significantly increased by the method of the invention because to stress this fact once more, the same machinery can be used to manufacture both double nap and flat fabrics.

It will be obvious to those skilled in the art that many modifications may be made within the scope of the present invention without departing from the spirit thereof, and the invention includes all such modifications.

What is claimed is:

1. In the method for the single-filling manufacture of double nap fabrics, wherein the filling yarn for the face and back fabrics is inserted at the same place into the shed, the improvement comprising superposing an additional lifting motion to the normal motion emanating from a dobby at least for shafts forming the shed of the warp for one of the two fabrics.

2. A method according to claim 1 in which the additional lifting motion takes place as an enlargement of the spacing between the two fabrics at the time of the reed beat-up.

3. A method according to claim 1 in which the lifting motion for the face fabric and the back fabric is mutually opposite.

4. A method according to claim 1 in which the magnitude of the lifting motion is adjustable.

5. A method according to claim 1 in which the time-phase of the additional lifting motion can be adjusted with respect to the reed beat-up.

6. In a weaving machine for the single-filling manufacture of double nap fabrics wherein the filling yarn for the face and back fabrics is inserted at the same place into the shed, the improvement comprising means for superposing an additional lifting motion to the normal motion emanating from a dobby at least for shafts forming the shed of the warp for one of the two fabrics.

7. A weaving machine according to claim 6 including switching levers between individual shafts and said dobby controlling the motion of the shafts, rotatably supported shaft means adapted to rotate by one revolution per operational cycle and acting as a bearing for switching levers which are not otherwise affected, and circular eccentric means mounted on said shaft means and acting as bearings for switching levers of ground warp shafts adapted to implement said superposed motion.

8. A weaving machine according to claim 7 including meand whereby the angular position of the circular eccentric means with respect to said shaft means may be continuously adjusted.

9. A weaving machine according to claim 7 including double rocker yarn tensioning means adapted to compensate the tension of a nap yarn between a working place thereof and a nap warp beam.

10. A weaving machine according to claim 7 including means whereby said circular eccentric means can be fixed in a neutral position with respect to the reed beat-up.

11. A weaving machine according to claim 10 including means whereby said shaft means can be locked into a static position and held in place when said circular eccentric means are in a neutral position.

* * * * *